US007038371B2

(12) United States Patent
Fushimi

(10) Patent No.: US 7,038,371 B2
(45) Date of Patent: May 2, 2006

(54) IMAGE FORMING APPARATUS

(75) Inventor: Masahiro Fushimi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 248 days.

(21) Appl. No.: 10/727,526

(22) Filed: Dec. 5, 2003

(65) Prior Publication Data

US 2004/0124762 A1 Jul. 1, 2004

(30) Foreign Application Priority Data

Dec. 27, 2002 (JP) ..... 2002-380951

(51) Int. Cl.
*H01J 1/62* (2006.01)
*H01J 63/04* (2006.01)

(52) U.S. Cl. ..... 313/495; 313/292; 313/497

(58) Field of Classification Search ..... 313/495–497
See application file for complete search history.

(56) References Cited

U.S. PATENT DOCUMENTS

| | | | | |
|---|---|---|---|---|
| 5,066,883 | A | 11/1991 | Yoshioka et al. | 313/309 |
| 5,083,058 | A | 1/1992 | Nonomura et al. | 313/482 |
| 5,682,085 | A | 10/1997 | Suzuki et al. | 315/169.1 |
| 5,742,117 | A * | 4/1998 | Spindt et al. | 313/495 |
| 5,828,352 | A * | 10/1998 | Nomura et al. | 345/74.1 |
| 6,351,065 | B1 * | 2/2002 | Yamazaki et al. | 313/497 |
| 6,656,007 | B1 | 12/2003 | Fushimi et al. | 445/24 |
| 6,657,368 | B1 | 12/2003 | Kosaka et al. | 313/310 |
| 2002/0031974 | A1 | 3/2002 | Ito et al. | 445/24 |
| 2003/0141803 | A1 | 7/2003 | Fushimi | 313/495 |

FOREIGN PATENT DOCUMENTS

| | | |
|---|---|---|
| JP | 57-118355 | 7/1982 |
| JP | 2-257551 | 10/1990 |
| JP | 3-049135 | 3/1991 |
| JP | 4-28137 | 1/1992 |
| JP | 2000-235831 | 8/2000 |

* cited by examiner

*Primary Examiner*—Mariceli Santiago
(74) *Attorney, Agent, or Firm*—Fitzpatrick,Cella,Harper & Scinto

(57) ABSTRACT

In an image forming apparatus including an electron-source substrate having a plurality of cold-cathode electron emitting elements, each having an electron emitting portion and a pair of element electrodes, an acceleration electrode for applying an acceleration voltage operating on electrons emitted from the electron emitting elements, disposed so as to face the electron emitting elements, a spacer disposed between the electron-source substrate and the acceleration electrode, a wiring portion formed on the electron-source substrate for driving the electron emitting elements, these components being accommodated within an envelope, an electron-trajectory correcting electrode for correcting beam deviation due to charging of the spacer is provided near an electron emitting element near the spacer.

6 Claims, 12 Drawing Sheets

IMAGE FORMING APPARATUS

BACKGROUND OF THE INVENTION

1. Field of the Invention

The present invention relates to an electron-beam apparatus, and an image forming apparatus, such as a display apparatus or the like, to which the electron-beam apparatus is applied. More particularly, the invention relates to a method for correcting beam deviation near a supporting member (a spacer) within an envelope.

2. Description of the Related Art

Two types of electron emitting elements, i.e., thermionic sources and cold-cathode electron sources, have been known. The cold-cathode electron sources include field-emission elements (hereinafter abbreviated as "FE elements"), metal-insulator-metal elements (hereinafter abbreviated as "MIM elements"), surface-conduction electron emitting elements (hereinafter abbreviates as "SCE elements"), and the like.

For example, the SCE elements have the feature that a large number of elements can be formed on a large area because of a simple structure and easiness of manufacture. For example, image forming apparatuses, such as image display apparatuses and image recording apparatuses, charged-beam sources, and the like are being studied as application fields of the SCE elements.

Particularly, as proposed, for example, in U.S. Pat. No. 5,066,883, and Japanese Patent Application Laid-Open (Kokai) Nos. 2-257551 (1990) and 4-28137 (1992) by the assignee of the present application, image display apparatuses obtained by combining SCE elements and phosphors emitting light by being irradiated by electron beams are being studied as application of SCE elements. Image display apparatuses of this type are expected to have characteristics superior to other conventional types of image display apparatuses. For example, image display apparatuses of this type are superior to recently diffused liquid-crystal display apparatuses in that a backlight is unnecessary because they emit light by themselves and the angle of view is wide.

In image display apparatuses of this type, spacer are usually disposed between a rear plate and a faceplate. A sufficient mechanical strength is required for the spacer in order to support the atmospheric pressure, and the spacer must not greatly influence the trajectory of electrons traveling between the rear plate and the faceplate. The factor for influencing the electron trajectory is charging of the spacer. The charging of the spacer is considered to be caused by incidence of part of electrons emitted from an electron source or electrons reflected by the faceplate onto the spacer followed by emission of secondary electrons from the spacer, or adherence of ions produced by collision of electrons to the surface of the spacer.

When the spacer is charged to a positive value, since electrons traveling near the spacer are attracted to the spacer, a displayed image is distorted near the spacer. The influence of charging is more pronounced as the distance between the rear plate and the faceplate is larger.

In order to prevent such a phenomenon, there is a method of forming an electrode for correcting the electron trajectory on the spacer (Japanese Patent Application Laid-Open (Kokai) No. 2000-235831), and a method of removing charges by causing some current to flow. Japanese Patent Application Laid-Open (Kokai) No. 57-118355 (1982) discloses a method of coating the surface of the spacer with tin oxide by applying a method of providing conductivity to the spacer.

Japanese Patent Application Laid-Open (Kokai) No. 3-49135 (1991) discloses a method of coating the spacer with a PdO-type glass material. Furthermore, destruction of the spacer due to insufficient connection or current concentration can be prevented by forming electrodes at connecting portions of the spacer with the faceplate and the rear plate of the spacer and applying an uniform electric field to the coated material.

By forming an electrode for correcting the electron trajectory on the spacer or forming a high-resistance film on the surface of the spacer as described above, it is possible to mitigate charging of the spacer and suppress attraction of electrons traveling near the spacer to the spacer.

In the above-described conventional methods, however, influence by charging of the spacer sometimes appears depending on the pitch between elements or driving conditions for the elements. For example, when the pitch between elements is small, influence by charging of the spacer appears because the spacer is close to electron emitting portions. Furthermore, for example, when driving conditions, such as the acceleration voltage and the driving voltage, change, the electric field around the spacer changes, resulting sometimes in incapability of removing charges even if a high-resistance film is formed on the spacer.

SUMMARY OF THE INVENTION

It is an object of the present invention to provide an image forming apparatus capable of correcting beam deviation due to charging of a spacer with high accuracy irrespective of the pitch between elements and driving conditions.

According to one aspect of the present invention, an image forming apparatus includes an electron-source substrate having a plurality of cold-cathode electron emitting elements, each having an electron emitting portion and a pair of element electrodes, an acceleration electrode for applying an acceleration voltage operating on electrons emitted from the electron emitting elements, disposed so as to face the electron emitting elements, a spacer disposed between the electron-source substrate and the acceleration electrode, a wiring portion formed on the electron-source substrate for driving the electron emitting elements, these components being accommodated within an envelope, and an electron-trajectory correcting electrode for correcting beam deviation due to charging of the spacer, provided near an electron emitting element near the spacer.

According to another aspect of the present invention, an image forming apparatus includes an electron-source substrate having a plurality of electron emitting elements, an acceleration electrode for applying an acceleration voltage operating on electrons emitted from the electron emitting elements, disposed so as to face the electron emitting elements, a spacer disposed between the electron-source substrate and the acceleration electrode, a wiring portion formed on the electron-source substrate for driving the electron emitting elements, these components being accommodated within an envelope, and an electron-trajectory correcting electrode for deflecting a trajectory of electrons emitted from an electron emitting element closest to the spacer so as to be separated from the spacer, disposed on the electron-source substrate in a state of being separated from the spacer.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Figure 1:
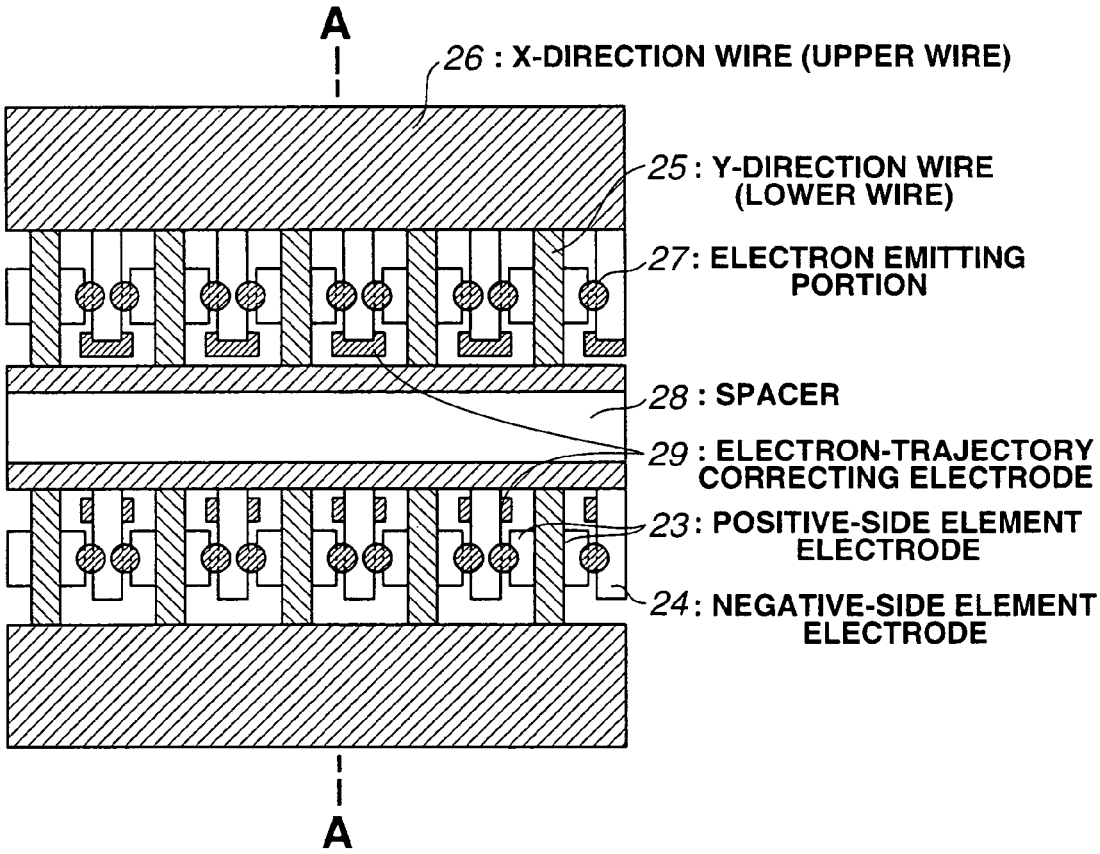
FIG. 1 is a plan view illustrating an image forming apparatus according to a first embodiment of the present invention.

The present invention is characterized in that, in an image forming apparatus including an electron-source substrate having a plurality of cold-cathode electron emitting elements, each having an electron emitting portion and a pair of element electrodes, an acceleration electrode for applying an acceleration voltage operating on electrons emitted from the electron emitting elements, disposed so as to face the electron emitting elements, a spacer disposed between the electron-source substrate and the acceleration electrode, and a wiring portion formed on the electron-source substrate for driving the electron emitting elements, these components being accommodated within an envelope, an electron-trajectory correcting electrode for correcting beam deviation due to charging of the spacer is provided near an electron emitting element near the spacer.

In the present invention, it is preferable that the electron-trajectory correcting electrode is connected to one of the pair of electrode electrodes, that the electron-trajectory correcting electrode is formed simultaneously with the element electrodes, that a potential applied to the electron-trajectory correcting electrode is substantially equal to a potential of a positive-side-electrode or a negative-side-electrode for a driving voltage, that the electron-trajectory correcting electrode is connected to a wire connected to one of the element electrodes, that a grid is provided between the electron-source substrate and the acceleration electrode, that the spacer has a high-resistance film on its surface, and that the electron emitting element is an SCE element.

The present invention is characterized in that, in an image forming apparatus includes an electron-source substrate having a plurality of electron emitting elements, an acceleration electrode for applying an acceleration voltage operating on electrons emitted from the electron emitting elements, disposed so as to face the electron emitting elements, a spacer disposed between the electron-source substrate and the acceleration electrode, and a wiring portion formed on the electron-source substrate for driving the electron emitting elements, these components being accommodated within an envelope, an electron-trajectory correcting electrode for deflecting a trajectory of electrons emitted from an electron emitting element closest to the spacer so as to be separated from the spacer is disposed on the electron-source substrate in a state of being separated from the spacer.

In the present invention, it is preferable that the electron-source substrate has a plurality of lines of the electron emitting elements, the spacer is disposed for each of the plurality of lines, and the electron-trajectory correcting electrode is disposed between the spacer and one of the plurality of lines closest to the spacer, that the electron-source substrate has a plurality of lines of the electron emitting elements, the spacer is disposed for each of the plurality of lines, and the electron-trajectory correcting electrode is disposed so as to sandwich the spacer and one of the plurality of lines closest to the spacer, that the electron-trajectory correcting electrode is disposed on a surface of the substrate where the electron emitting elements are disposed, that the electron-trajectory correcting electrode is disposed on the wiring portion, that the electron-trajectory correcting electrode is electrically connected to a component of the electron emitting elements, that the electron-trajectory correcting electrode is formed in a process that is the same as a process for the component of the electron emitting elements, that a potential applied to the electron-trajectory correcting electrode is substantially equal to a potential of a positive-side-electrode or negative-side-electrode for a driving voltage, that the electron-trajectory correcting electrode is electrically connected to the wire, that a grid is provided between the electron-source substrate and the acceleration electrode, and that the spacer has a resistive film on its surface.

The present invention can be applied to any other known electron emitting elements, such as FE elements, SCE elements, MIM elements, and the like.

The inventor of the present invention and others have found after intensive studies that an electron trajectory can be very precisely corrected by forming a correcting electrode near an electron emitting portion near a spacer, in order to form an electric field for correcting the electron trajectory so as to be separated from the spacer at a portion near the electron emitting portion to deflect the electron trajectory, and to correct an amount of attraction by charging of the spacer.

In a method of forming a correcting electrode on an electron-source substrate, it is possible to use a very precise process, such as photolithography or the like, and to uniformly and very precisely form the correcting electrode, compared with a method of individually forming a correcting electrode on a spacer. It is also possible to form a correcting electrode using the same manufacturing method irrespective of the shape of the spacer. Furthermore, by connecting the correcting electrode to one of element electrodes or a wire connected to the element electrode, it is possible to easily form an electric field for deflecting in advance a beam attracted by the charged spacer in a repelled direction.

According to the present invention, it is possible to correct beam deviation due to charging of the spacer, and provide an undistorted high-quality image. Furthermore, beam deviation can be corrected without forming a high-resistance film on the spacer. When a high-resistance film is formed on the spacer, the range of control can be widened.

Preferred embodiments of the present invention will now be described in detail with reference to the drawings.

(First Embodiment)

FIG. 1 is a plan view illustrating an electron-source substrate having electron emitting elements in the shape of a matrix for an image forming apparatus according to a first embodiment of the present invention. In FIG. 1, there are shown positive-side element electrodes 23, negative-side element electrodes 24, y-direction wires (lower wires) 25, x-direction wires (upper electrodes) 26, and element films 27 of SCE elements, serving as electron emitting portions. There are also shown a spacer 28, and electron-trajectory correcting electrodes 29 provided near the spacer 28 and near the electron emitting elements. As will be described in detail later, the electron-trajectory correcting electrode 29 is for correcting an electron trajectory, and is connected to the x-direction wire 26.

The element electrodes 23 and 24 are obtained by first forming a titanium (Ti) layer 5 nm thick as an undercoat and then forming a platinum (Pt) layer 40 nm thick on a glass substrate according to sputtering, followed by patterning according to photolithography consisting of resist coating, exposure, development and etching. The electron-trajectory correcting electrodes 29 are formed simultaneously with the element electrodes 23 and 24.

A material for the x-direction wires 25 and the y-direction wires 26 is desired to provide a low resistance in order to apply a substantially uniform voltage to a large number of SCE elements. The material, the thickness and the width of the wires are appropriately set.

The y-direction wires (lower wires) 25 are formed in the shape of a pattern of lines so as to contact the positive-side element electrodes 23. Ag photo-paste ink is used as the material for the y-direction wires 25. The y-direction wires 25 are formed by performing screen printing of the ink, drying the printed ink, exposing and developing a predetermined pattern, and thereafter firing the patterned ink at a temperature near 480° C. The thickness and the width of the formed wires 25 are about 10 μm and about 50 μm, respectively. Although not illustrated in FIG. 1, the width of end portions of the y-direction wires 25 are increased in order to be used as wire extracting electrodes.

In order to insulate the y-direction wires (lower wires) 25 from the x-direction wires (upper wires) 26, an interlayer insulating layer (not shown) is formed. This layer is formed so as to cover crossings between the x-direction wires (upper wires) 26 and the y-direction wires (lower wires) that have been formed before the x-direction wires 26, while providing contact holes (not shown) at connecting portions so as to allow electric connection of the x-direction wires 26 to the negative-side element electrodes 24.

The interlayer insulating film is formed by performing screen printing of a photosensitive glass paste containing PbO as a main component, then repeating exposure/development processing four times, and finally firing the coated paste at a temperature near 480° C. The thickness and the width of the interlayer insulating film are about 30 μm in total, and 150 μm, respectively.

The x-direction wires (upper wires) 26 are formed on the formed interlayer insulating film by performing processing of screen printing of Ag paste ink and drying the coated ink, twice, and firing the ink at a temperature near 480° C. The x-direction wires 26 cross the y-direction wires 25 via the interlayer insulating film, and are connected to the negative-side element electrodes 24 via the contact holes of the interlayer insulating film.

The negative-side element electrodes 24 connected to the x-direction wires 26 operate as scanning electrodes after forming the panel. The thickness of the x-direction wires 26 is about 20 μm. Although not illustrated, extracting wires to be connected to an external driving circuit are formed according to a method similar to the above-described method. Thus, the electron-source substrate having the wires in the form of an xy matrix is manufactured.

After sufficiently cleaning the manufactured electron-source substrate, the surface of the substrate is processed with a solution containing a water repellent agent in order to make the surface hydrophobic. This processing is performed in order to provide a state in which an aqueous solution for forming an element film to be thereafter coated is provided on the element electrodes with an appropriate spread.

Figure 2A:
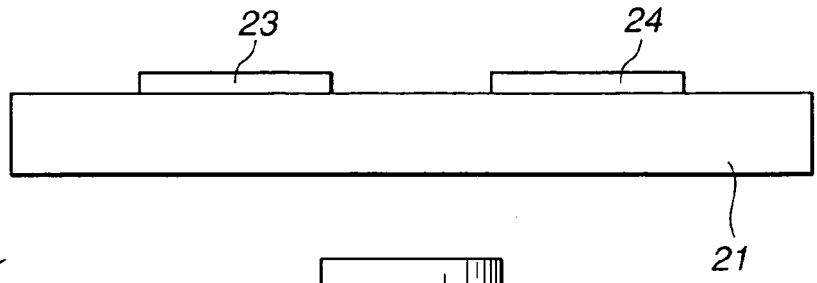
FIGS. 2A–2C are diagrams illustrating a method of forming an element film of an electron emitting element.
Figure 2B:
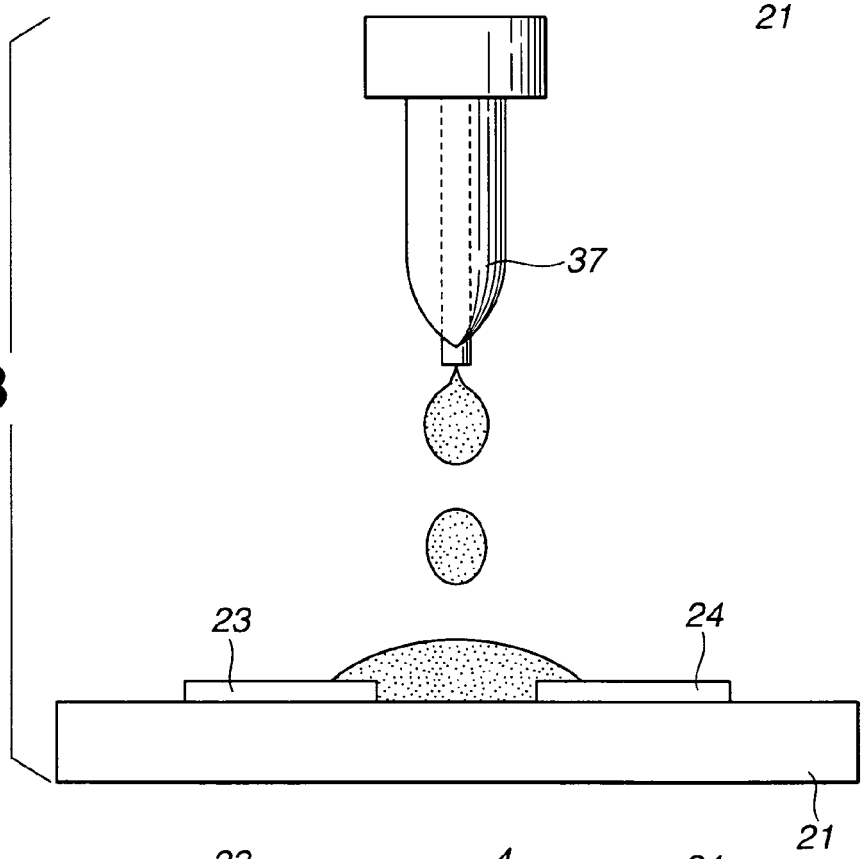
Figure 2C:
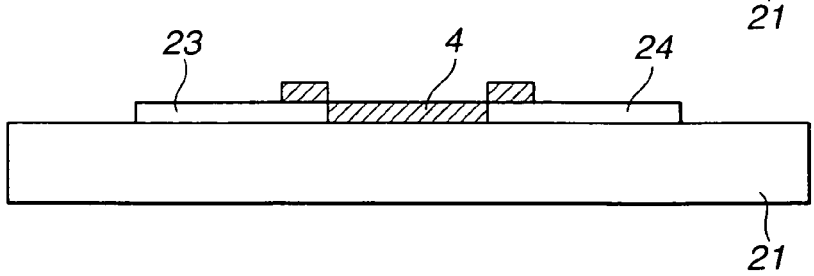

Then, an element film 4 is formed between element electrodes according to ink-jet coating followed by heating/firing processing. The element film 4 corresponds to the electron emitting portion 27 shown in FIG. 1 before performing forming processing and activating processing. FIGS. 2A–2C are schematic diagrams of this process. FIG. 2A illustrates the substrate before forming the element film 4. In FIG. 2A, there are shown a glass substrate 21, and the element electrodes 23 and 24 shown in FIG. 1.

In the first embodiment, in order to obtain a palladium film as the element film 4, a solution containing organic palladium is prepared by dissolving 0.15 weight % of a palladium-proline complex in an aqueous solution including 85% of water and 15% of isopropyl alcohol (IPA). Some additive agent is also added.

Then, as shown in FIG. 2B, droplets of this solution are provided between the electrodes by performing adjustment so as to provide a dot diameter of 60 μm, using an ink-jet injector having piezoelectric elements as droplet providing means 37. Then, the substrate is fired for ten minutes at 350° C. in air to provide palladium oxide (PdO). As a result, as shown in FIG. 2C, the element film 4 having a dot diameter of about 60 μm and a thickness of 10 nm at maximum is obtained. According to the above-described process, a palladium oxide (PdO) film is formed at the element portion.

Next, forming processing will be described. This is the processing of forming the electron emitting portion by producing cracks within the conductive film (element film 4) by causing current to flow in the conductive film. More specifically, a hood-shaped lid is placed on the glass substrate 21 so as to cover the entire substrate except for the extracting-electrode portion at the circumference of the glass substrate 21, and a space surrounded by the lid and the substrate is evacuated. In this state, by applying a voltage between the x-direction wires and the y-direction wires from an external power supply via the electrode terminals to allow current to pass between the element electrodes, the conductive thin film is locally destructed, deformed or altered to form a high-resistance electron emitting portion.

At that time, if the conductive thin film is heated by causing current to flow in a vacuum atmosphere containing some hydrogen gas, reduction is accelerated by hydrogen, so that the palladium oxide (PdO) film is converted into a palladium (Pd) film. At that time, cracks are produced at part of the film due to contraction caused by reduction of the film. The positions and the shapes of the cracks greatly influence the uniformity of the original film. In order to suppress deviations of characteristics of a large number of elements, it is desirable that the cracks are produced at a central portion between the element electrodes and are as rectilinear as possible.

Electron emission occurs also near cracks produced by this forming processing at a predetermined voltage. However, in this state, the efficiency of generation of electron emission is still very low. The resistance value Rs of the obtained conductive thin film is between $10^2$–$10^7$ Ω.

Figure 3A:
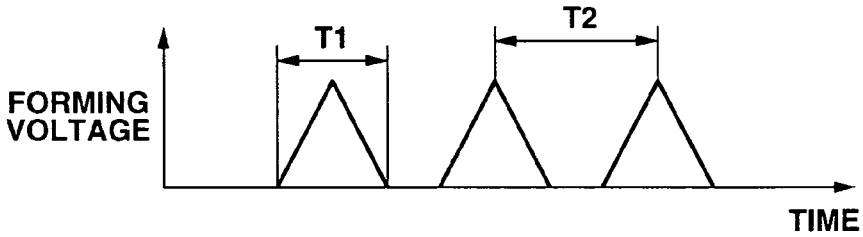
FIGS. 3A and 3B are diagrams illustrating forming voltages used for forming processing.
Figure 3B:
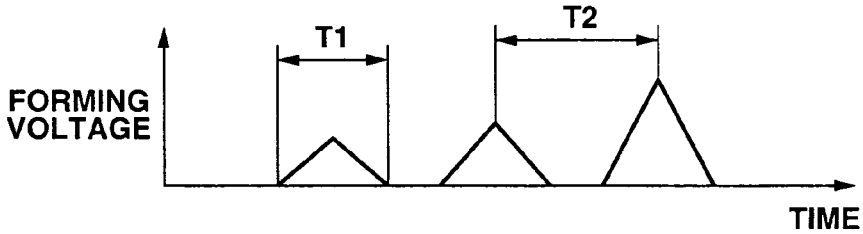

FIGS. 3A and 3B illustrate the waveforms of voltages used for forming processing. The applied voltage has the shape of a pulse. There are a case in which pulses having a constant peak value are applied as shown in FIG. 3A, and a case in which pulses having increasing peak values are applied as shown in FIG. 3B.

In FIG. 3A, T1 and T2 represent the pulse width of the voltage waveform and the pulse interval, respectively. T1 and T2 are set to 1 μsec-10 msec, and 10 μsec-100 msec, respectively, and the peak value of the triangular wave (the peak voltage during forming) is appropriately selected. In the case of FIG. 3B, each of T1 and T2 always has the same value, and the peak value of the triangular wave (the peak voltage during forming) is increased stepwise, for example, by about 0.1 V.

The element current is measured by inserting a pulse voltage having a value so as not to locally destruct or deform the conductive thin film, for example, about 0.1 V, between adjacent pulses for forming, and the resistance value is obtained from the result of the measurement. The forming processing is terminated, for example, when the resistance value becomes at least 1,000 times the resistance value before the forming processing.

Next, activation processing will be described. In the above-described state, the efficiency of electron emission is very low. In order to improve the efficiency of electron emission, it is desirable to perform processing called activation processing for the above-described element. This processing is performed in an appropriate degree of vacuum containing an organic compound by covering a hood-shaped lid on the substrate as in the forming processing, and repeatedly applying a pulse voltage between the element electrodes from the outside via the x-direction wires and the y-direction wires. By introducing a gas containing carbon atoms, a carbon film containing carbon or a carbon compound is deposited near the cracks.

In the activation processing, tolunitrile is used as a carbon source, that is introduced into the vacuum space via a slow leakage valve to maintain a pressure of $1.3\times10^{-4}$ Pa. Although somewhat influenced by the shape of the vacuum apparatus, components used in the vacuum apparatus, and the like, the pressure of the introduced toluniltrile is preferably about $1\times10^{-5}$ Pa–$1\times10^{-2}$ Pa.

Figure 4A:
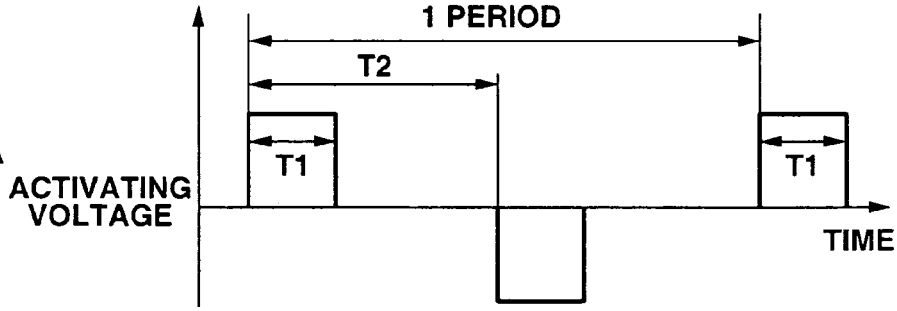
FIGS. 4A and 4B are diagrams illustrating activating voltages used for activating processing.
Figure 4B:
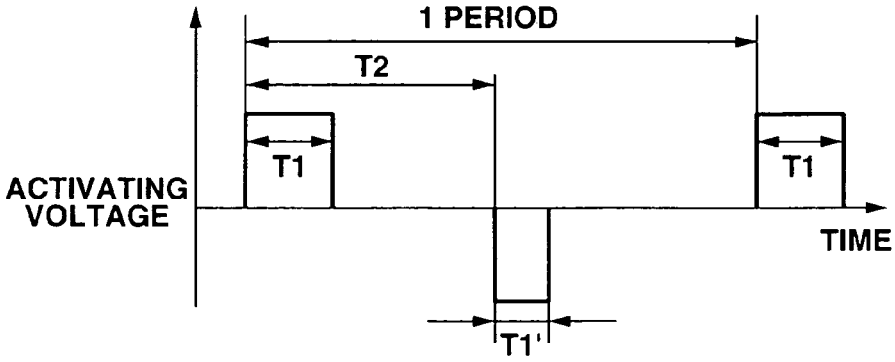

FIGS. 4A and 4B illustrate preferable examples of voltage application used in activation processing. The maximum voltage to be applied is appropriately selected within a range of 10–20 V. In FIG. 4A, T1 and T2 represent the widths of positive and negative pulses and the interval between the pulses in the voltage waveform, respectively. The positive and negative pulses have the same absolute voltage value. In FIG. 4B, T1 and T1' represent the widths of positive and negative pulses in the voltage waveform, respectively, and T2 represents the interval between the pulses. It is set so that T1>T1', and the positive and negative pulses have the same absolute value.

At that time, a positive voltage is applied to the element electrode 24, and the element current If flows from the element electrode 24 to the element electrode 23. Current supply is stopped when the emission current Ie substantially saturates after about 60 minutes, and the activation processing is terminated by closing the slow leakage valve. According to the above-described processes, an electron-source substrate having electron-source elements can be manufactured.

Figure 5:
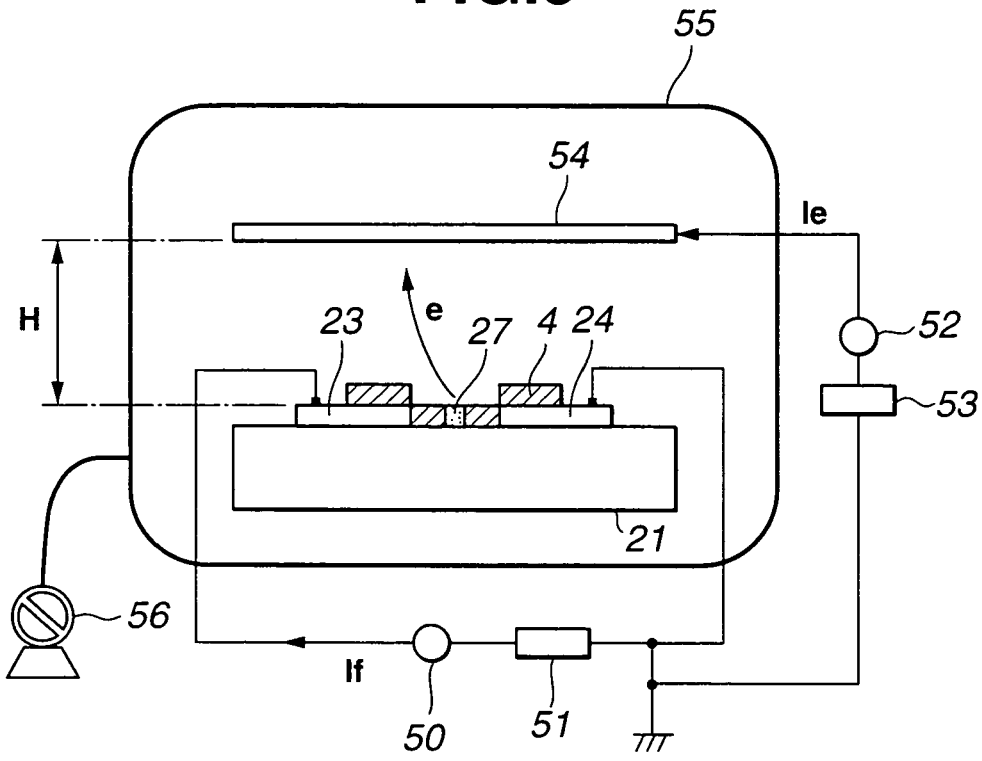
FIG. 5 is a diagram illustrating a measuring evaluation apparatus for measuring electron emission characteristics.

Next, the basic characteristics of the electron emitting element manufactured with the configuration and according to the method that have been described above will be described with reference to FIGS. 5 and 6. FIG. 5 illustrates a measuring evaluation apparatus for measuring the electron emission characteristics of the element having the above-described configuration. When measuring the element current If flowing between the element electrodes of the electron emitting element and the emission current Ie to the anode, a power supply 51 and an ammeter 50 are connected to the element electrodes 23 and 24, and an anode electrode 54 connected to a power supply 53 via an ammeter 52 is disposed above the electron emitting element.

In FIG. 5, there are shown the glass substrate 21, the element electrodes 23 and 24, the thin film 4 including the electron emitting portion 27, and the electron emitting portion 27. The power supply 51 applies an element voltage Vf to the element, the ammeter 50 measures the element current If flowing through the conductive thin film including the electron emitting portion 27 between the element electrodes 23 and 24, the anode electrode 54 catches the emission current Ie emitted from the electron emitting portion of the element, the high-voltage power supply 53 applies a voltage to the anode electrode 54, and the ammeter 52 measures the emission current Ie emitted from the electron emitting portion 27 of the element.

The electron emitting element and the anode electrode 54 are disposed within a vacuum apparatus, which has a vacuum pump, a vacuum gauge and the like that are necessary for the vacuum pump. The element is measured/evaluated in a desired vacuum. The voltage applied to the anode electrode 54 is 1–10 kV, and the distance H between the anode electrode 54 and the electron emitting element is within a range of 1–8 mm.

Figure 6:
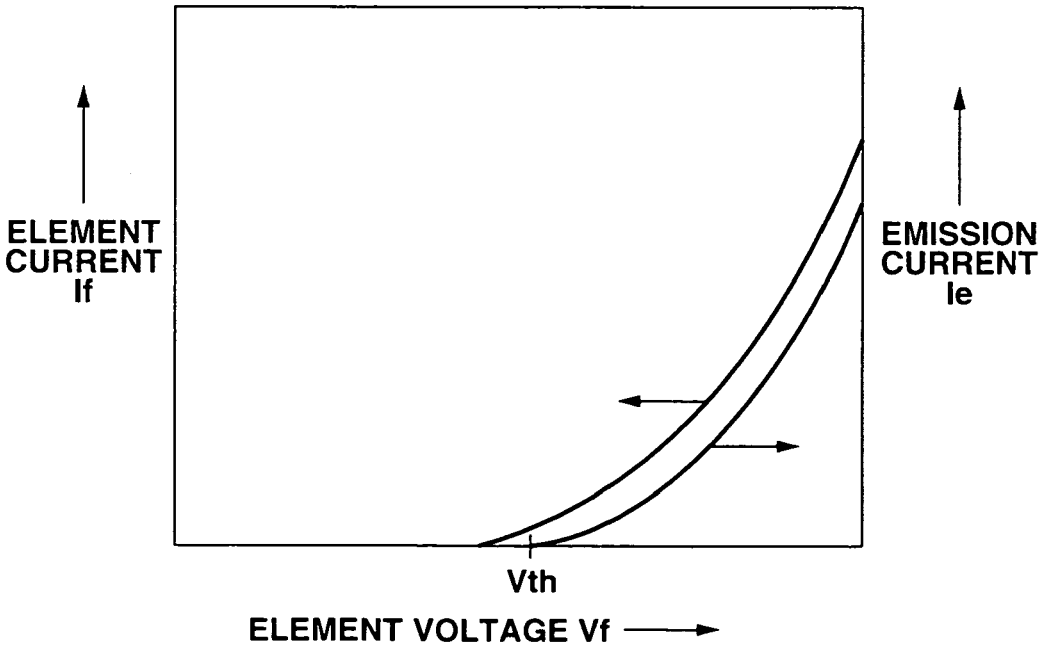
FIG. 6 is a graph illustrating characteristics of an electron emitting element.

FIG. 6 illustrates a typical example of the relationship between the emission current Ie and the element current If, and the element voltage Vf measured by the measuring evaluation apparatus shown in FIG. 5. The values of the emission current Ie and the element current If greatly differ. In FIG. 6, however, respective ordinates are represented in a linear scale with arbitrary units for the purpose of qualitative comparison of changes of the currents If and Ie. The measured emission current Ie when a voltage of 12 V was applied between the element electrodes was 0.6 μA on average, and the electron emission efficiency was 0.15% on average. Uniformity among elements was excellent, such that variations in the current Ie among elements had an excellent value of 5%.

The electron emission element of the invention has three features with respect to the emission current Ie. First, as is apparent from FIG. 6, the emission current Ie abruptly increases when an element voltage is equal to or larger than a certain voltage (termed a "threshold voltage", i.e., Vth shown in FIG. 6), and the emission current Ie is hardly detected at a voltage smaller than the threshold voltage Vth. That is, it can be understood that this element has a characteristic as a nonlinear element having a distinct threshold voltage Vth for the emission current Ie.

Second, since the emission current Ie depends on the element voltage Vf, the emission current Ie can be controlled by the element voltage Vf. Third, discharged electron charges caught by the anode electrode 54 depend on the time of application of the element voltage Vf. That is, the amount of electric charges caught by the anode electrode 54 can be controlled by the time of application of the element voltage Vf.

Figure 7:
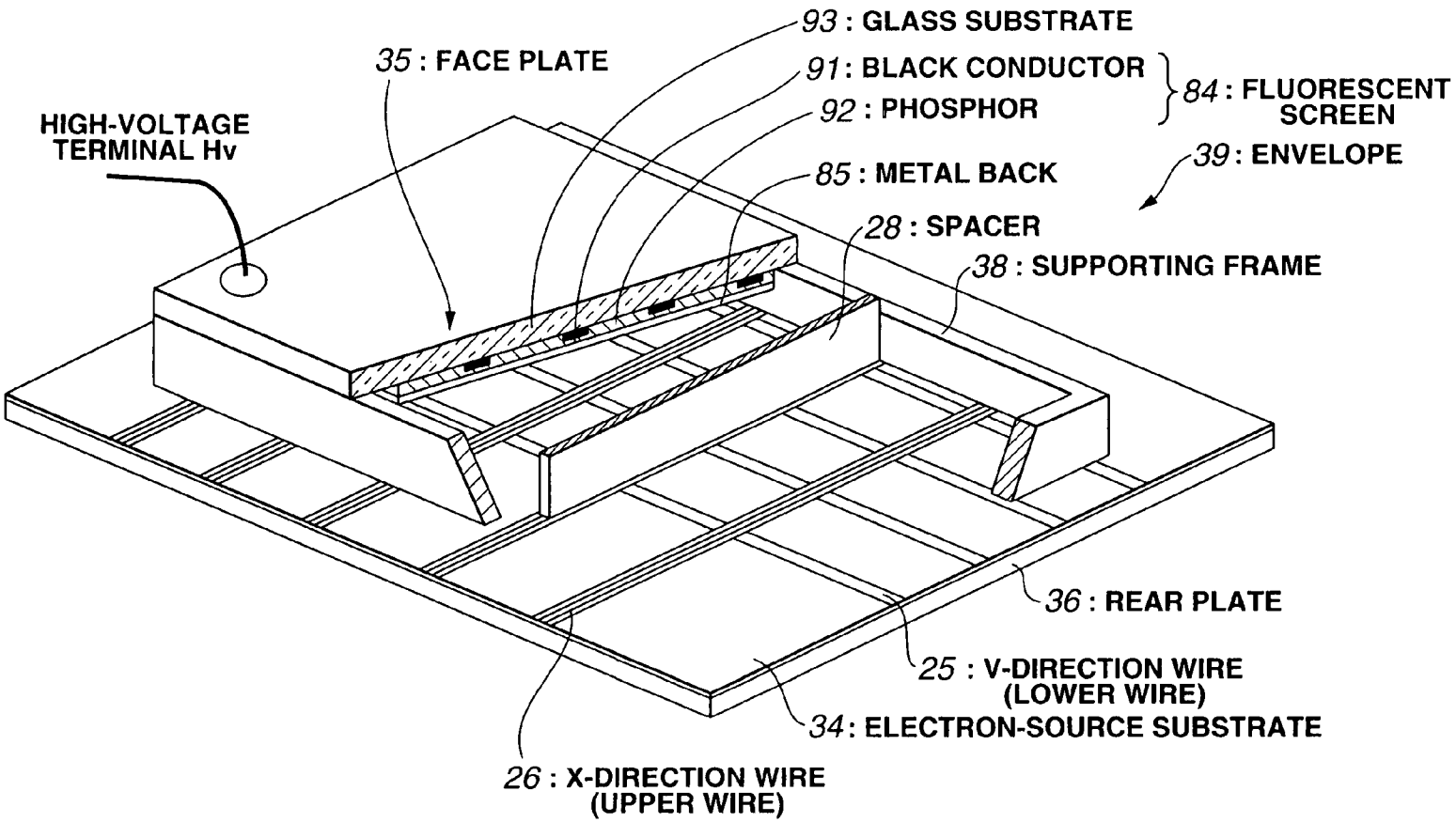
FIG. 7 is a perspective view illustrating the entire configuration of the image forming apparatus shown in FIG. 1.

FIG. 7 is a partially broken perspective view when an image forming apparatus is configured using the above-described electron-source substrate. In FIG. 7, there are shown a faceplate 35, and a rear plate 36. Spacer 28 are provided between the faceplate 35 and the rear plate 36. There are also shown a supporting frame 38, and an envelope 39. As shown in FIG. 7, the envelope 39 is configured by connecting the electron-source substrate 34, the faceplate 35, the rear plate 36, and the supporting frame 38.

The faceplate 35 includes a glass substrate 93, a fluorescent screen 84, and a metal back 85. The fluorescent screen 84 only includes phosphors in the case of a monochromatic screen. In the case of a color fluorescent screen, the fluorescent screen 84 includes a black conductor 91 called black stripes, a black matrix, or the like, depending of the phosphor arrangement, and phosphors 92. The reason for providing black stripes or a black matrix is to make color mixture and the like less pronounced by making portions between adjacent ones of three-primary-color phosphors, that are necessary in the case of color display, black to suppress reduction of contrast due to reflection of external light at the fluorescent screen 84.

A metal back 85 is usually provided on the inner surface of the fluorescent screen 84, for example, in order to increase luminance by mirror reflection of light emitted from the phosphors toward the faceplate 35, and operate as an anode electrode (acceleration electrode) for applying a electron-beam acceleration voltage. The metal back 85 is manufactured by performing smoothing processing (usually called filming) of the inner surface of the fluorescent screen 84 after forming the fluorescent screen 84, and then depositing Al according to vacuum deposition or the like.

When performing sealing, it is necessary, in the case of color display, to perform sufficient positioning, for example, by alignment of the upper and lower substrate, because the phosphors of respective colors and electron emitting elements must correspond to each other.

During sealing, a degree of vacuum of about $10^{-5}$ Pa is required, and getter processing is sometimes performed in order to maintain the degree of vacuum within the envelope 39 after sealing. This is processing for forming a vacuum-deposited film by heating a getter disposed at a predetermined position (not shown) within the envelope 39 according to a heating method, such as resistance heating, high-frequency heating or the like, immediately before or after performing sealing of the envelope 39. The getter usually has Ba as a main component. For example, a degree of vacuum of $1\times10^{-5}$–$1\times10^{-10}$ Pa is maintained by the adsorption function of the vacuum-deposited film.

According to the basic characteristics of the SCE element of the invention, electrons emitted from the electron emitting portion are controlled by the peak value and the width of the pulse-shaped voltage applied between facing element electrodes at a voltage equal to or larger than the threshold voltage, and the current value is also controlled by an intermediate value of the voltage, so that halftone display can be performed.

When a large number of electron emitting elements are arranged, by determining a selected line by a scanning-line signal for each line and appropriately applying the above-described pulse-shaped voltage to each element via a corresponding information signal line, it is possible to apply an appropriate voltage to an arbitrary element to turn on the element. Methods for modulating an electron emitting element in accordance with a halftone input signal include a voltage modulation method and a pulse-width modulation method.

Figure 8:
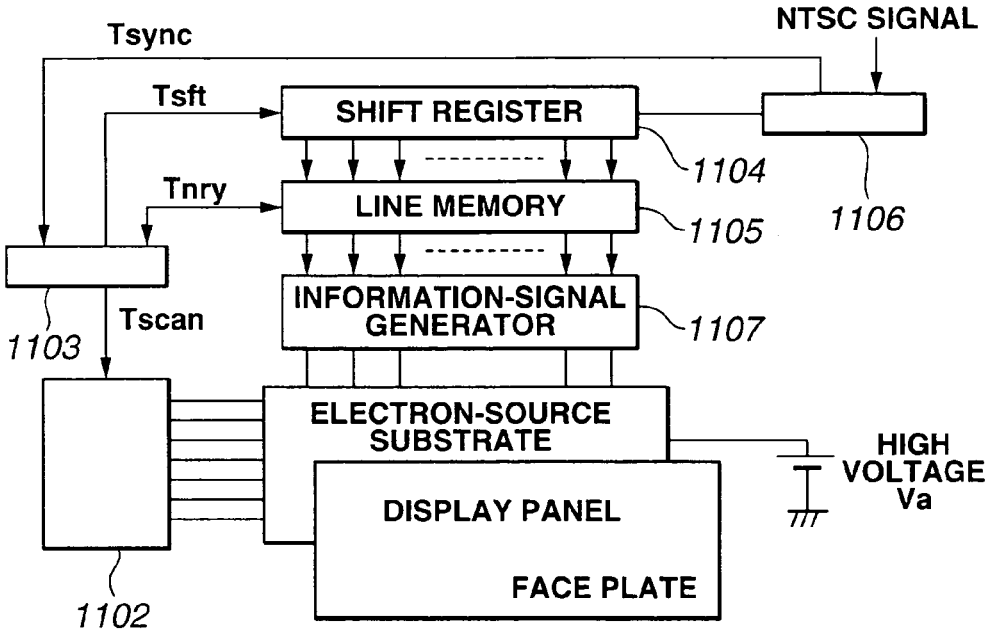
FIG. 8 is a block diagram illustrating a driving apparatus according to the first embodiment.

Next, a specific driving method will be described. FIG. 8 illustrate a configuration of an image display apparatus for television display in which a display panel using electron sources arranged in the shape of a simple matrix is driven based on an NTSC television signal.

In FIG. 8, there are shown an image display panel 1101, a scanning circuit 1102, a control circuit 1103, a shift register 1104, a line memory 1105, a synchronizing-signal separation circuit 1106, an information-signal generator 1107, and DC voltage sources Vx and Va. The scanning circuit (x-driver) 1102 for applying a scanning-line signal, and the information-signal generator 1107, serving as a y-driver for applying an information signal are connected to x-direction wires and y-direction wires of the image display panel 1101 using electron emitting elements, respectively.

In the voltage modulation method, a circuit that generates voltage pulses having a constant length and appropriately changes the peak value of the pulse in accordance with input data is used as the information-signal generator 1107. In the pulse-width modulation method, a circuit that generates voltage pulses having a constant peak value and appropriately changes the pulse width in accordance with input data is used as the information-signal generator 1107.

The control circuit 1103 outputs control signals Tscan, Tsft and Tnry to corresponding components based on a synchronizing signal Tsync transmitted from the synchronizing-signal separation circuit 1106. The synchronizing-signal separation circuit 1106 separates a synchronizing-signal component and a luminance-signal component from an NTSC television signal input from the outside. The luminance-signal component is supplied to the shift register 1104 in synchronization with a synchronizing signal.

The shift register 1104 performs serial-parallel conversion of a time-serially-input luminance signal for each line of an image, and operates based on a shift clock signal transmitted from the control circuit 1103. Data for one line of the image subjected to serial-parallel conversion (corresponding to driving data for n electron emitting elements) is output from the shift register 104 as n parallel signals.

The line memory 1105 stores data for one line of an image for a necessary time. The stored contents are input to the information-signal generator 1107. The information-signal generator 1107 is a signal source for appropriately driving each electron emitting element in accordance with each luminance signal. An output signal from the information-signal generator 1107 is supplied to the display panel 1101 via a y-direction wire, and is supplied to an electron emitting element present at a crossing with a selected scanning line via an x-direction wire. By sequentially scanning x-direction wires, electron emitting elements on the entire display panel can be driven.

As described above, an image can be displayed by emitting electrons by applying a voltage to each electron emitting element via x-direction and y-direction wires within the panel, applying a high voltage to the metal back 85, serving as the anode electrode, via the high-voltage terminal Hv, and accelerating the generated electron beam so as to impinge upon the fluorescent screen 84.

The above-described configuration of the image forming apparatus is an example of the image forming apparatus, and various modifications can be provided based on the technical concept of the present invention. Although an NTSC input signal has been illustrated, the input signal is not limited to such a signal. For example, a PAL signal, a HDTV signal or the like may also be adopted.

Figure 9:
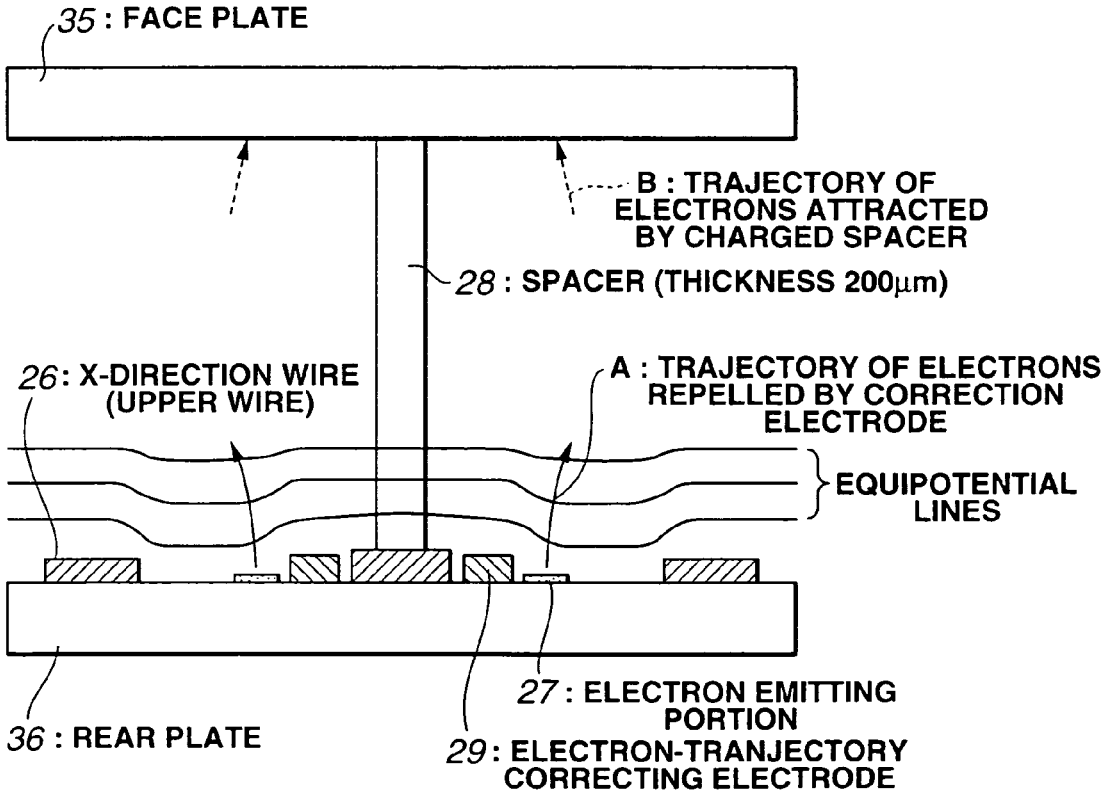
FIG. 9 is a cross-sectional view taken along line A—A shown in FIG. 1.

FIG. 9 is a cross-sectional view taken along line A—A shown in FIG. 1. In FIG. 9, the same components as those shown in FIGS. 1 and 7 are indicated by the same reference numerals. The electron-trajectory correcting electrode 29 is disposed on the same surface of the substrate (rear plate 36) as the electron emitting element, i.e., in the first embodiment, the SCE element including the element electrodes 23 and 24, and the element film including the electron emitting portion 27, and is formed as one body with the negative-side element electrode 24. A negative potential is applied to the electron-trajectory correcting electrode 29 during electron emission. As a result, as shown in FIG. 9, equipotential lines are formed, and an electric field to separate electrons from the spacer 28 at a portion near the electron emitting portion 27, i.e., a trajectory of electrons repelled by the electron-trajectory correcting electrode 29 as indicated by an arrow A, is formed.

On the other hand, a trajectory of electrons attracted by the spacer 28 due to charging of the spacer 28 as indicated by an arrow B is formed. Since this trajectory is cancelled by the electron trajectory A by the electron-trajectory correcting electrode 29, the electron trajectory attracted to the spacer 28 due to charging of the spacer 28 can be corrected. Accordingly, influence by charging of the spacer 28 can be prevented, and an undistorted image can be obtained.

In order to correct the electron trajectory due to charging of the spacer 28 by the electron-trajectory correcting electrode 29, a high-resistance film may be or may not be provided on the surface of the spacer 28. If a high-resistance film is provided on the surface of the spacer 28, the range of control can be further widened.

In the first embodiment, the distance between the electron-source substrate and the acceleration electrode is 1.6 mm, the element pitch is 614×205 μm, and the electron-trajectory correcting electrode 29 has a size of 100×20 μm. When the element was driven by applying an acceleration voltage of 10 kV, and driving voltages for the element of −7 V at the negative side (x-direction wire) and +7V at the positive side (y-direction wire), beam attraction by charging of the spacer was corrected, deviation of a position where a beam spot is formed was suppressed, and a high-quality image could be formed.

In the first embodiment, since the electron-trajectory correcting electrode 29 is formed simultaneously with the element electrodes 23 and 24, it is unnecessary to change the process, and an electron trajectory can be easily corrected.

In the first embodiment, since the electron-trajectory correcting electrode 29 is formed in the same process as for the element electrodes 23 and 24, serving as components of the electron emitting element, for determining the position of the electron emitting element on the substrate (the rear plate 36), the relative position between the electron emitting element and the electron-trajectory correcting electrode is much more exact than, for example, when integrally forming the electron-trajectory correcting electrode on the surface of the spacer, and is also more exact than when forming the electron-trajectory correcting electrode on wires as will be described later.

In the first embodiment, in order to obtain a high degree of vacuum within the image forming apparatus to be manufactured, a minimum necessary number of spacers 28 are disposed. That is, instead of being disposed on all of the x-direction wires, the spacers 28 are disposed at every plurality of electron-emitting-portion lines, each comprising a plurality of electron emitting portions 27 arranged in the form of a line, and the electron-trajectory correcting electrode 29 is disposed between the spacer 28 and the nearest electron-emitting-portion line.

(Second Embodiment)

Figure 10:
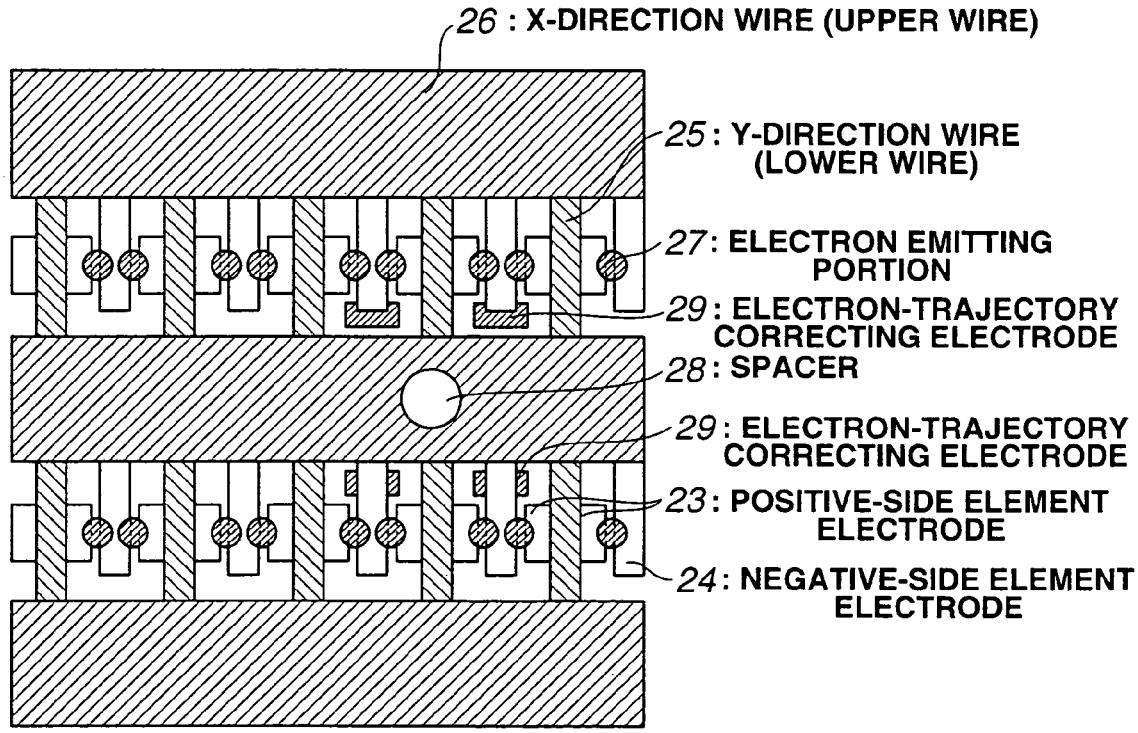
FIG. 10 is a plan view illustrating a second embodiment of the present invention.

FIG. 10 is a plan view illustrating a second embodiment of the present invention. In FIG. 10, the same components as those shown in FIG. 1 are indicated by the same reference numeral, and further description thereof will be omitted. The second embodiment differs from the first embodiment in that cylindrical spacers 28 are used. Other components are the same as in the first embodiment.

In the second embodiment, the distance between the electron-source substrate and the acceleration electrode is 1.4 mm, the element pitch is 615×205 μm, and the electron-trajectory correcting electrode 29 has a size of 100×20 μm. In contrast to the first embodiment, electron-trajectory correcting electrodes 29 are formed only at four near element portions surrounding the cylindrical spacer 28 having a diameter of 150 μm. As in the first embodiment, the electron-trajectory correcting electrodes 29 are formed simultaneously with the element electrodes 23 and 24.

When the element was driven by applying an acceleration voltage of 8 kV, and driving voltages for the element of −7.5 V at the negative side (x-direction wire) and +7.5 V at the positive side (y-direction wire), deviation of a position where a beam spot is formed was suppressed, and a high-quality image could be formed.

Figure 11:
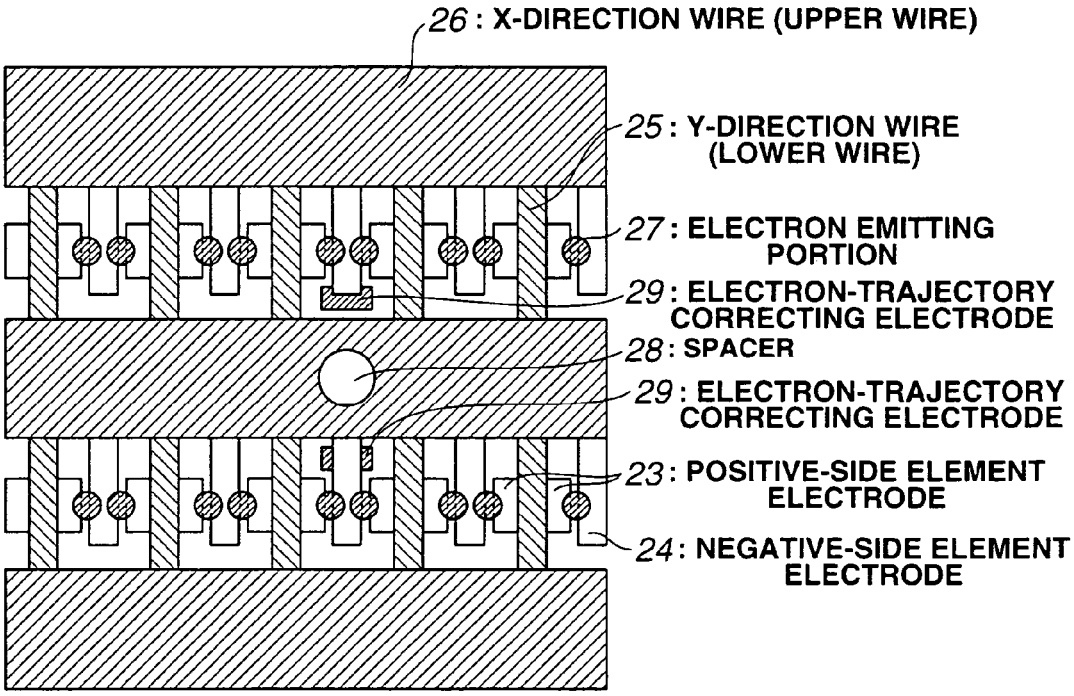
FIG. 11 is a plan view illustrating a modification of FIG. 10.

In the second embodiment, since the electron-trajectory correcting electrode 29 is formed simultaneously with the element electrodes 23 and 24, it is unnecessary to change the process, and an electron trajectory can be easily corrected. When the position of arrangement of the spacer 28 differs as shown in FIG. 11, similar correction can be performed by forming the electron-trajectory correcting electrodes 29 near the spacer 28 so as to surround the spacer 28.

In the second embodiment, also, since the electron-trajectory correcting electrodes 29 are formed in the same process as for the element electrodes 23 and 24, serving as components of the electron emitting element, for determining the position of the electron emitting element on the substrate (the rear plate 36), the relative position between the electron emitting element and the electron-trajectory correcting electrode is much more exact than, for example, when integrally forming the electron-trajectory correcting electrode on the surface of the spacer, and is also more exact than when forming the electron-trajectory correcting electrode on wires as will be described later.

In the second embodiment, also, in order to obtain a high degree of vacuum within the image forming apparatus to be manufactured, a minimum necessary number of spacers 28 are disposed. That is, instead of being disposed on all of the x-direction wires, the spacers 28 are disposed at every plurality of electron-emitting-portion lines, each comprising a plurality of electron emitting portions 27 arranged in the form of a line, and the electron-trajectory correcting electrode 29 is disposed between the spacer 28 and the nearest electron-emitting-portion line.

(Third Embodiment)

Figure 12:
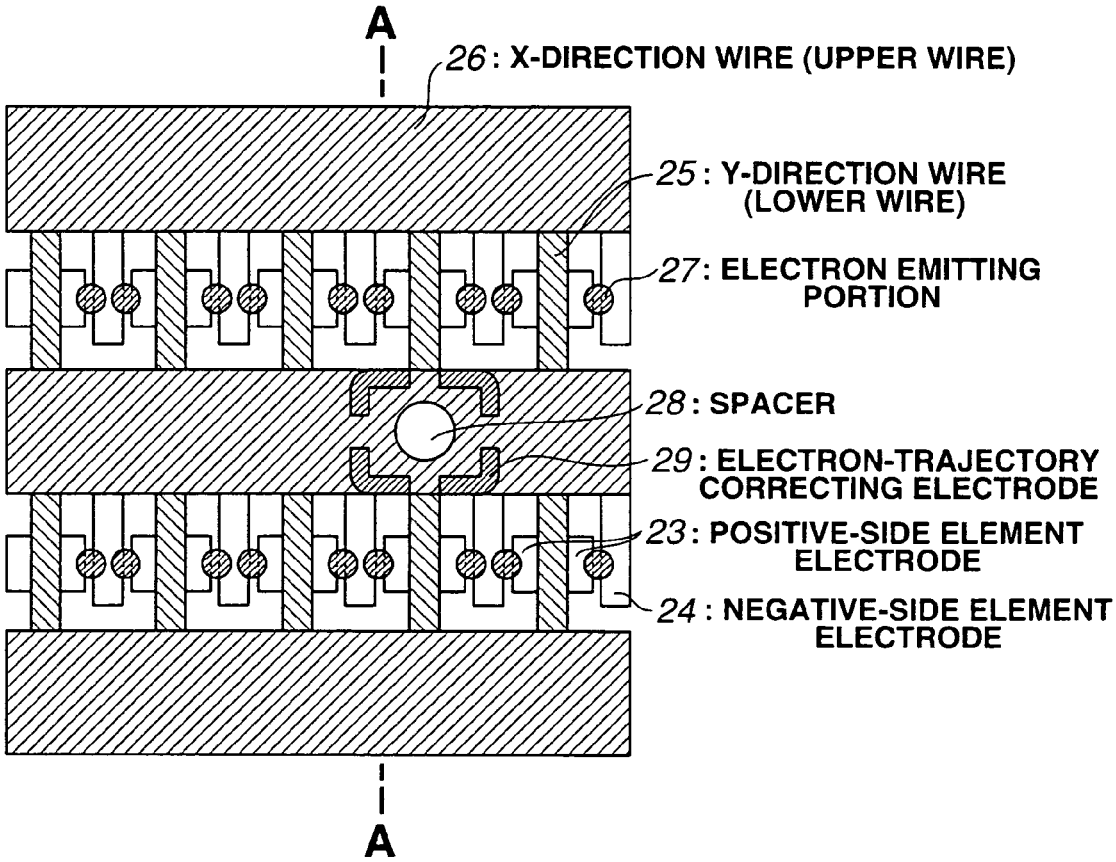
FIG. 12 is a plan view illustrating a third embodiment of the present invention.
Figure 13:
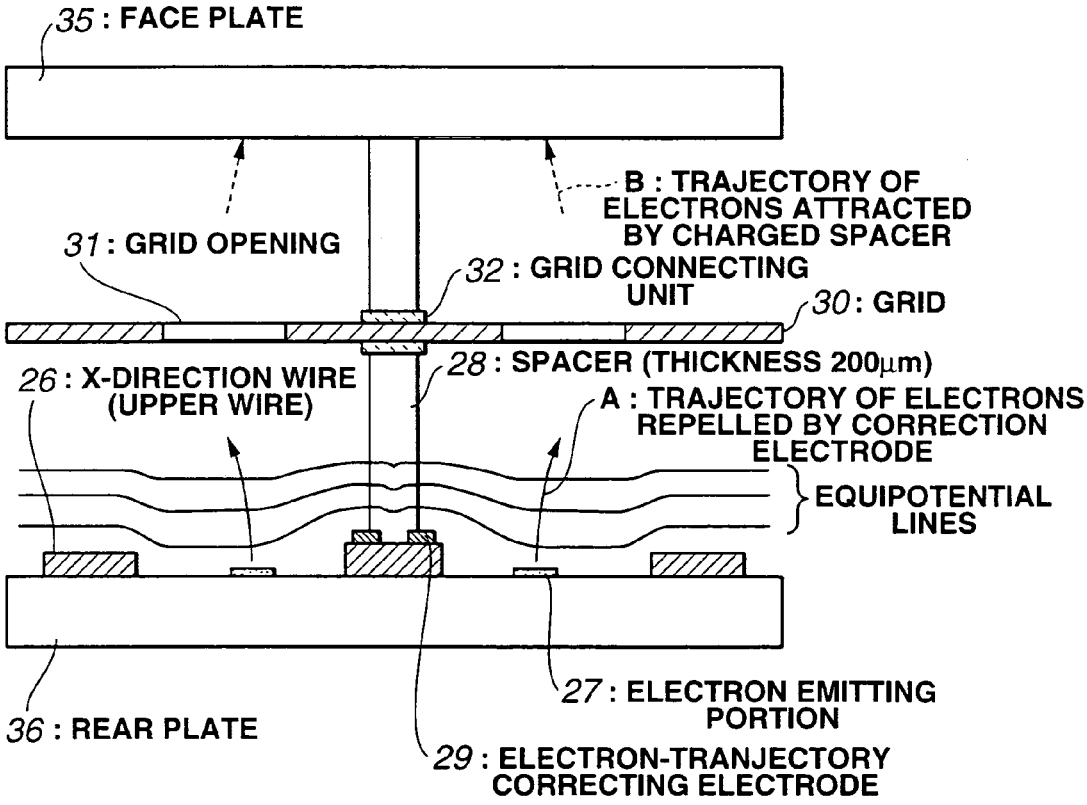
FIG. 13 is a cross-sectional view taken along line A—A shown in FIG. 12.

FIG. 12 is a plan view illustrating a third embodiment of the present invention. FIG. 13 is a cross-sectional view taken along line A—A shown in FIG. 12. In the third embodiment, as in the second embodiment, cylindrical spacers 28 are used, and electron-trajectory correcting electrodes 29 are formed on part of each x-direction wire 26. The electron-trajectory correcting electrodes 29 are formed at portions near the spacer 28 on the x-direction wire 26 according to screen printing. Four electron-trajectory correcting electrodes 29 are formed so as to surround the cylindrical spacer 28. Each of the electron-trajectory correcting electrodes 29 has a size of 100×100 μm, a line width of 50 μm, and a thickness of 10 μm.

As shown in FIG. 13, in order to cause a beam to converge, a grid 30 is provided at a height of 0.4 mm above electron emitting portions 27 on a rear plate 36. A voltage of 2.5 kV is applied to the grid 30. The size of a grid opening 31 is 300×120 μm. Cylindrical spacers 28 are provided above and below the grid 30, and are fixed to the grid 30 via respective grid connecting units 32. Other components are the same as in the first embodiment. The distance between the electron-source substrate and the acceleration electrode is 1.6 mm, the element pitch is 500×20 μm.

When the element was driven by applying an acceleration voltage of 10 kV, and driving voltages for the element of −7.5 V at the negative side (x-direction wire) and +7.5 V at the positive side (y-direction wire), deviation of a position where a beam spot is formed was suppressed, and a high-quality image could be formed.

In the third embodiment, the relative position between the electron emitting element and the electron-trajectory correcting electrode is much more exact than, for example, when integrally forming the electron-trajectory correcting electrode on the surface of the spacer.

In the third embodiment, also, in order to obtain a high degree of vacuum within the image forming apparatus to be manufactured, a minimum necessary number of spacers 28 are disposed. That is, instead of being disposed on all of the x-direction wires, the spacers 28 are disposed at every plurality of electron-emitting-portion lines, each comprising a plurality of electron emitting portions 27 arranged in the form of a line, and the electron-trajectory correcting electrode 29 is disposed between the spacer 28 and the nearest electron-emitting-portion line.

(Fourth Embodiment)

Figure 14:
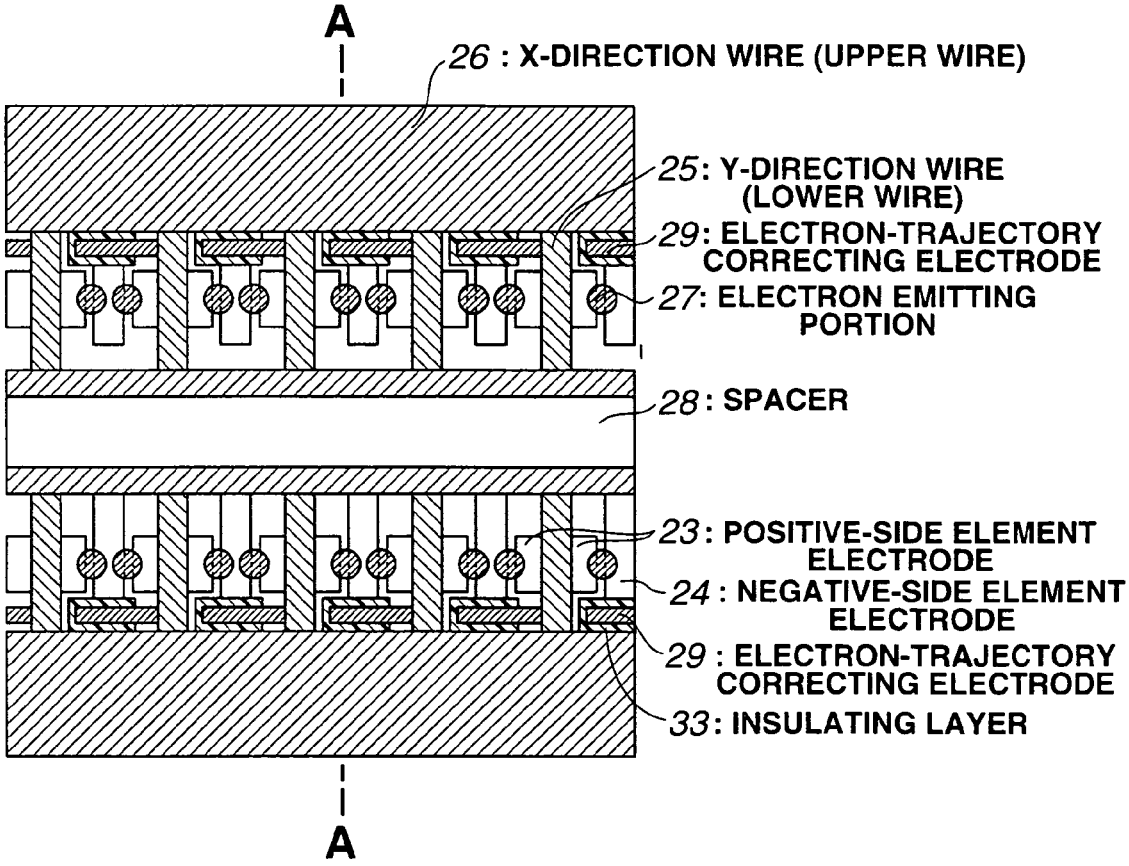
FIG. 14 is a plan view illustrating a fourth embodiment of the present invention.
Figure 15:
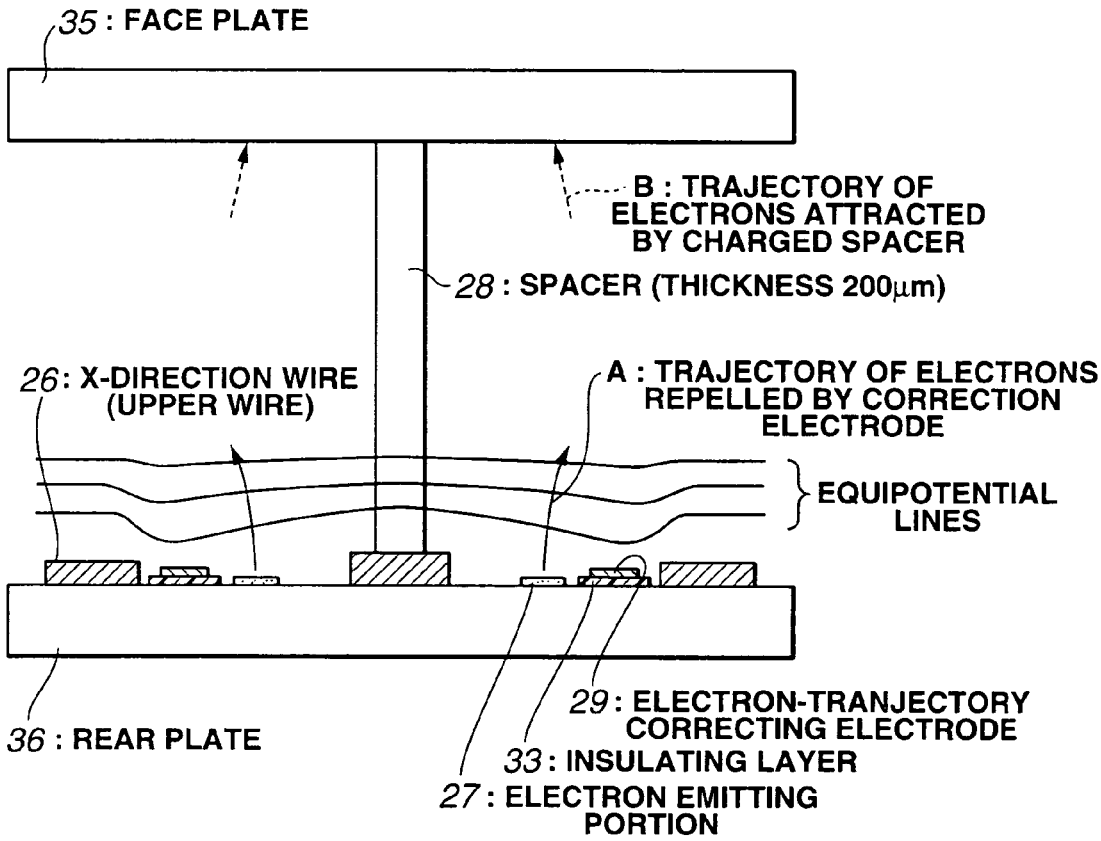
FIG. 15 is a cross-sectional view taken along line A—A shown in FIG. 14.

FIG. 14 is a plan view illustrating a fourth embodiment of the present invention. FIG. 15 is a cross-sectional view taken along line A—A shown in FIG. 14. In the fourth embodiment, each electron-trajectory correcting electrode 29 is connected to a y-direction wire 25, and is disposed at a position opposite to a spacer 28 for electron emitting portions 27 adjacent to the spacer 28. By applying a positive voltage to the electron-trajectory correcting electrode 29, an electric field for causing electrons to have a trajectory opposite to the spacer 28 is formed at a position near the electron emitting portion 27.

In the fourth embodiment, a desired pattern is obtained by performing lift-off processing of a silicon-oxide insulating layer 33 formed to a thickness of 200 nm according to sputtering after forming a resist pattern, after forming element electrodes. Then, the electron-trajectory correcting electrodes 29 is formed to a size of 150×20 μm according to a method similar to the method for forming the element electrodes in the first embodiment. Other components are the same as in the first embodiment. The distance between the electron-source substrate and the acceleration electrode is 1.8 mm, and the element pitch is 640×210 μm.

When the element was driven by applying an acceleration voltage of 10 kV, and driving voltages for the element of −9 V at the negative side (x-direction wire) and +6 V at the positive side (y-direction wire), deviation of a position where a beam spot is formed was suppressed, and a high-quality image could be formed, as shown in FIG. 15. In the fourth embodiment, also, since the electron-trajectory correcting electrodes 29 are formed on wires, the configuration of the fourth embodiment is particularly effective, for example, in a high-precision image forming apparatus having a small element pitch.

In the fourth embodiment, the relative position between the electron emitting element and the electron-trajectory correcting electrode is much more exact than, for example, when integrally forming the electron-trajectory correcting electrode on the surface of the spacer.

In the fourth embodiment, also, in order to obtain a high degree of vacuum within the image forming apparatus to be manufactured, a minimum necessary number of spacers 28 are disposed. That is, instead of being disposed on all of the x-direction wires, the spacers 28 are disposed at every plurality of electron-emitting-portion lines, each comprising a plurality of electron emitting portions 27 arranged in the form of a line, and the electron-trajectory correcting electrode 29 is disposed so as to sandwich the spacer 28 and the nearest electron-emitting-portion line.

As described above, according to the present invention, by forming electron-trajectory correcting electrodes near corresponding electron emitting portions near a corresponding spacer, it is possible to correct beam deviation due to charging of the spacer, and realize a high-quality image forming apparatus in which the beam position near the spacer does not change. Furthermore, it is possible to correct beam deviation without forming a high-resistance film on the spacer, and, when a high-resistance film is formed on the spacer, a range of control can be widened.

The individual components shown in outline or designated by blocks in the drawings are all well known in the image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an electron-source substrate having a plurality of electron emitting elements;

an acceleration electrode for applying an acceleration voltage operating on electrons emitted from the electron emitting elements, disposed so as to face the electron emitting elements;

a spacer disposed between said electron-source substrate and said acceleration electrode;

a wiring portion formed on said electron-source substrate for driving the electron emitting elements, these components being accommodated within an envelope; and an electron-trajectory correcting electrode for deflecting a trajectory of electrons emitted from an electron emitting element closest to said spacer so as to be separated from said spacer, disposed on said electron-source substrate in a state of being separated from said spacer, wherein said electron-trajectory correcting electrode is disposed on said wiring portion.

2. An image forming apparatus comprising:

an electron-source substrate having a plurality of electron emitting elements;

an acceleration electrode for anplying an acceleration voltage operating on electrons emitted from the electron emitting elements, disposed so as to face the electron emitting elements;

a spacer disposed between said electron-source substrate and said acceleration electrode;

a wiring portion formed on said electron-source substrate for driving the electron emitting elements, these components being accommodated within an envelope; and an electron-trajectory correcting electrode for deflecting a trajectory of electrons emitted from an electron emitting element closest to said spacer so as to be separated from said spacer, disposed on said electron-source substrate in a state of being separated from said spacer, wherein said electron-source substrate has a plurality of lines of the electron emitting elements, wherein said spacer is disposed for each of the plurality of lines, and said electron-trajectory correcting electrode is disposed between said spacer and one of the plurality of lines closest to said spacer.

3. An image forming apparatus according to claim 2, wherein said electron-trajectory correcting electrode is disposed on a surface of said electron-source substrate where the electron emitting elements are disposed.

4. An image forming apparatus according to claim 2, wherein said electron-trajectory correcting electrode is disposed on said wiring portion.

5. An image forming apparatus comprising:

an electron-source substrate having a plurality of electron emitting elements;

an acceleration electrode for applying an acceleration voltage operating on electrons emitted from the electron emitting elements, disposed so as to face the electron emitting elements;

a spacer disposed between said electron-source substrate and said acceleration electrode;

a wiring portion formed on said electron-source substrate for driving the electron emitting elements, these components being accommodated within an envelope; and an electron-trajectory correcting electrode for deflecting a trajectory of electrons emitted from an electron emitting element closest to said spacer so as to be separated from said spacer, disposed on said electron-source substrate in a state of being separated from said spacer, wherein said electron-source substrate has a plurality of lines of the electron emitting elements, wherein said spacer is disposed for each of the plurality of lines, and said electron-trajectory correcting electrode is disposed so as to sandwich said spacer and one of the plurality of lines closest to said spacer.

6. An image forming apparatus according to claim 5, wherein said electron-trajectory correcting electrode is disposed on said wiring portion.

* * * * *

UNITED STATES PATENT AND TRADEMARK OFFICE

CERTIFICATE OF CORRECTION

PATENT NO. : 7,038,371 B2
APPLICATION NO. : 10/727526
DATED : May 2, 2006
INVENTOR(S) : Masahiro Fushimi It is certified that error appears in the above-identified patent and that said Letters Patent is hereby corrected as shown below:

ON THE TITLE PAGE [56] REFERENCES CITED:

U.S. Patent Documents, "6,656,007 B1 12/2003 Fushimi et al." should read --6,656,007 B2 12/2003 Fushimi et al.--.

SHEET 10:

Figure 13, "TRANJECTORY" should read --TRAJECTORY--.

SHEET 12:

Figure 15, "TRANJECTORY" should read --TRAJECTORY--.

COLUMN 1:

Line 19, "abbreviates" should read --abbreviated--; and
Line 41, "spacer" should read --spacers--.

COLUMN 7:

Line 50, "toluniltrile" should read --tolunitrile--.

COLUMN 10:

Line 6, "illustrate" should read --illustrates--.

COLUMN 13:

Line 54, "is" should read --are--.

UNITED STATES PATENT AND TRADEMARK OFFICE

CERTIFICATE OF CORRECTION

PATENT NO. : 7,038,371 B2
APPLICATION NO. : 10/727526
DATED : May 2, 2006
INVENTOR(S) : Masahiro Fushimi It is certified that error appears in the above-identified patent and that said Letters Patent is hereby corrected as shown below:

COLUMN 15:

Line 1, “anplying” should read --applying--.

Signed and Sealed this

Fourteenth Day of November, 2006

JON W. DUDAS
*Director of the United States Patent and Trademark Office*